United States Patent [19]

Boersma

[11] 4,257,892

[45] Mar. 24, 1981

[54] DRAIN COVER

[76] Inventor: Donald J. Boersma, 18610 S. John Ave., Country Club Hills, Ill. 60477

[21] Appl. No.: 105,156

[22] Filed: Dec. 19, 1979

[51] Int. Cl.[3] ..... E03F 1/00

[52] U.S. Cl. ..... 210/163

[58] Field of Search ..... 210/163, 164, 165, 166; 4/268, 275, 286

[56] References Cited

U.S. PATENT DOCUMENTS

| | | | |
|---|---|---|---|
| 931,019 | 8/1909 | Dawes et al. | 210/163 |
| 1,195,827 | 8/1916 | Luke | 210/163 |
| 2,800,231 | 7/1957 | Hicks | 210/163 |
| 2,928,419 | 3/1960 | Kruse | 210/163 |
| 3,212,416 | 10/1965 | Boersma | 210/163 |
| 3,674,149 | 7/1972 | Donalson | 210/163 |
| 3,727,763 | 4/1973 | Arenskov | 210/163 |
| 4,042,983 | 8/1977 | Carpentier | 210/163 |

*Primary Examiner*—Theodore A. Granger
*Attorney, Agent, or Firm*—David D. Kaufman

[57] ABSTRACT

An improved drain cover comprising a one-piece top disc and depending cylindrical body adapted to be readily inserted into a drain pipe with the disc resting on the floor and overlying the pipe opening. The body is formed with four radial slots in which trapezoidal locking slugs are slidably positioned. The body is also formed with a central bore, the lower portion of which is adapted to receive a frusto-conical camming plug. A threaded bolt is slidably positioned through the disc and is threadedly engageable with the plug. When the bolt is tightened, it raises the plug into the bore where it cams the slugs outwardly into locking engagement with the drain pipe.

8 Claims, 5 Drawing Figures

DRAIN COVER

This invention relates to floor drain covers and, more particularly, to an improved drain cover having adjustable means for positively locking the same in operational position.

Many of the problems attendant the installation, use and maintenance of floor drain covers are described in my prior U.S. Pat. No. 3,212,416. That structure represented a substantial improvement over the traditional circular grate which had to be precisely fitted atop a drain pipe in order to make a flush union with the surrounding floor. Thus, for example, its resilient fingers provided a generally satisfactory friction fit with limited adjustability to compensate for minor variations in the drain pipe internal structure and dimensions. Also, the cover overlaid the drain pipe opening so that fine finishing of the surrounding floor covering was no longer necessary.

At best, the resilient fingers provided a frictional fit with only limited gripping force. After extended use, it was sometimes found that the resilient and frictional gripping force was diminished or lost, resulting in an undesirable looser fit. Similarly, removal of the drain cover for cleaning or replacement sometimes became difficult or almost impossible because of rusting or corrosion of the drain pipe and/or fingers.

It is, therefore, an object of this invention to provide an improved drain cover which overcomes all of the problems alluded to hereinabove.

In accordance with the present invention, the drain cover comprises an integral structure having a top cover disc and a cylindrical body adapted for loose telescopic insertion into the drain pipe. The body is provided with a central cavity which communicates with a plurality of slots radiating to the vertical body wall. A camming plug fits within the cavity and is adapted to force slugs slidably positioned in the slots radially outwardly. The plug may be readily adjusted from above to create a firm and immovable fit in which the slugs bear against the drain pipe inner wall. Preferably, the cover and cylindrical body is integrally molded of durable and rust-resistant plastics.

Another object of the invention is to provide a drain cover of the character described which achieves a positive, locking operational fit irrespective of variations or imperfections in the drain pipe.

Still another object is to provide in improved drain cover of the character described which may be readily installed or removed without requiring any specialized tools.

Yet another object is to provide an improved drain cover of the character described which is virtually indestructible and yet is attractive, easily cleaned and maintained, and most efficient for the purposes intended.

Other objects, features and advantages of the invention will be apparent from the following detailed disclosure, taken in conjunction with the accompanying drawings, wherein like reference numerals refer to like parts, in which.

Figure 1:
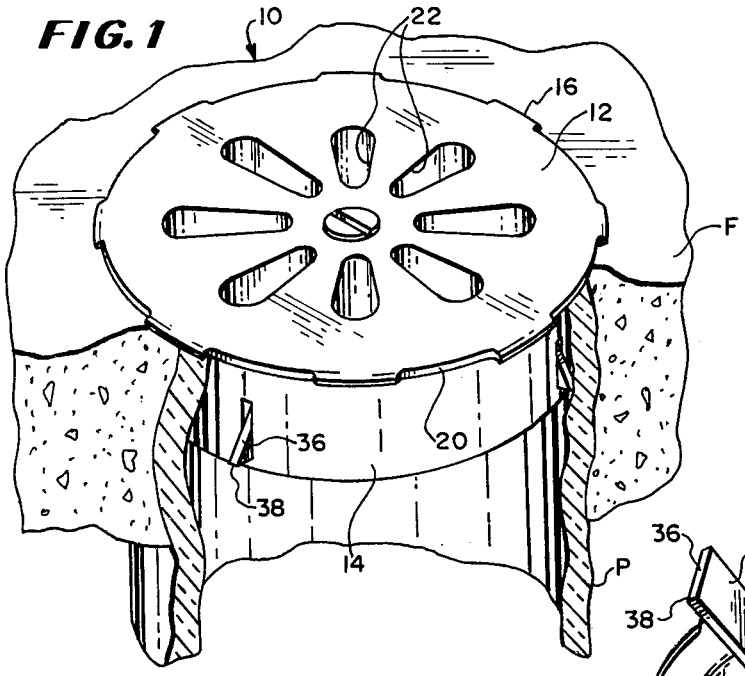
FIG. 1 is a perspective view of a drain cover embodying the principles of the invention and showing the same operationally positioned in a drain pipe.
Figure 2:
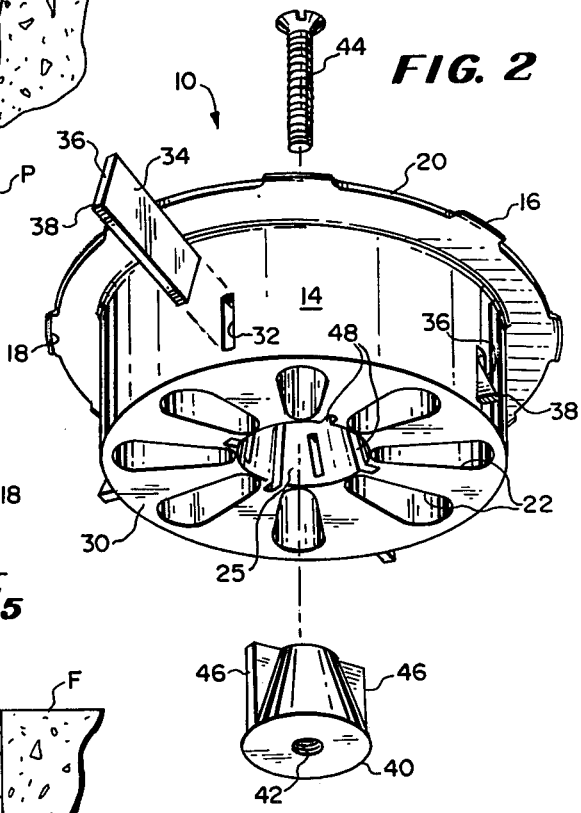
FIG. 2 is an exploded perspective view of the drain cover.

Turning with greater particularity to the various FIGS. of the drawings, the reference character 10 indicates generally an improved drain cover embodying the principles of the invention. Drain cover 10 comprises a top disc 12 and a depending, smaller diameter cylindrical body 14. The body 14 is of a diameter slightly smaller than that of the drain pipe P with which the same is to be used (e.g., 3-¾″ vs. 4″ for standard drain pipe), so that the same may be readily inserted therein. When the drain cover is so inserted into a drain pipe, the disc 12 overlies the opening in the floor F so that accurate or fine finshing of the opening, or of any floor covering such as linoleum or tile, is not required.

Marginal edge 16 of disc 12 is provided with a downwardly angled lip 18 and is also formed with a plurality of arcuate cut-outs or weep holes 20. Preferably, disc 12 is slightly convex in section so that when the drain cover is operationally positioned the weep holes 20 permit drainage of low lying liquids while the disc presents a low relief, smooth surface which is safe under foot and also permits objects to rolled or moved thereover.

The disc 12 and body 14 are formed with a plurality of radial drainage openings 22 to permit drainage of larger volume liquids. The disc and body are also formed with a central bore 25 whose function will become apparent as the description proceeds. While the disc and body may be made separately of suitable metals, or the like, I prefer to integrally mold the same from a durable and rust and corrosion-resistant plastic such as Lucite.

Central bore 25 comprises a frusto-conical lower section 26 which opens to the bottom 28 of the cylindrical body 14 and a circular upper section 30 which opens to the top disc 12. The body 14 is likewise formed internally with four radial slots 32 which communicate with the bore section 26 and also open to the body vertical wall.

A trapezoidal locking slug 34 is slidably and removably positioned in each of the slots 32. Owing to its trapezoidal shape, each of the slugs 34 has short, angled faces 36, 36 and acute corners 38, 38.

A camming plug 40 is adapted to fit into the lower section 26 of the bore 25, and it will be seen that said plug is of the same complementary, frusto-conical shape. The plug 40 is furnished with a centrally threaded hole 42 and a threaded bolt 44 slidably fittable within the upper bore section 30 is adapted to cooperate with said plug. In order to prevent rotation of the plug 40, the same is provided with radial fins 46, 46 adapted to fit within opposed pairs of vertical positioning slots 48 formed in the wall of the lower bore section 26.

Figure 3:
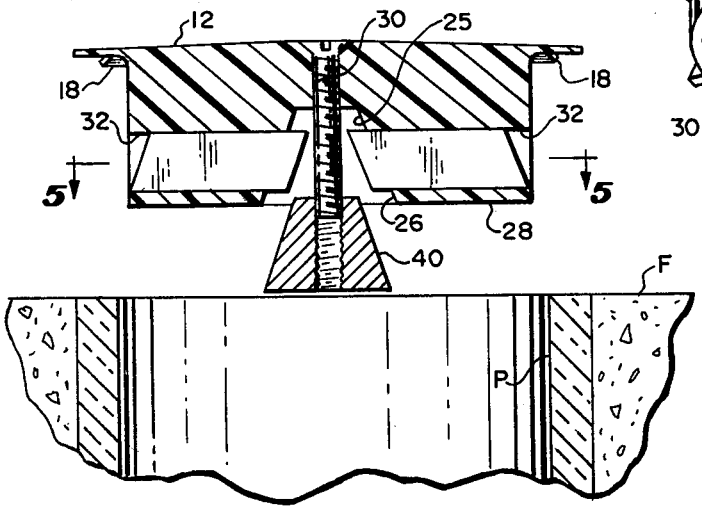
FIG. 3 is a vertical sectional view showing the drain cover ready for insertion into a drain pipe.
Figure 4:
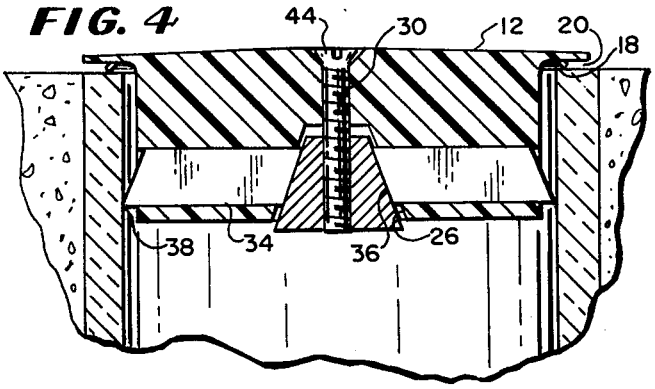
FIG. 4 is a similar view showing the drain cover operationally positioned and locked within the drain pipe.
Figure 5:
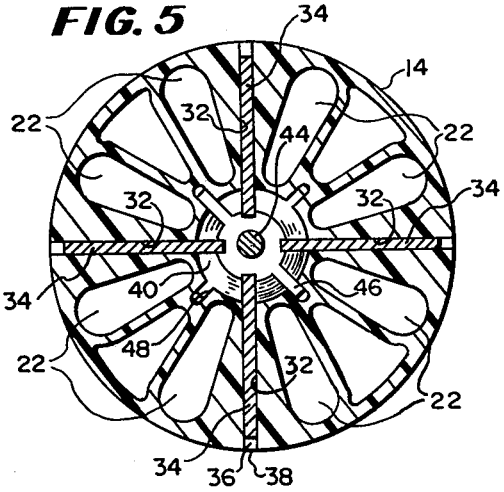
FIG. 5 is a horizontal sectional view taken on the plane of line 5—5 in FIG. 3 and viewed in the direction indicated by the arrows.

Operation and placement of the improved drain cover 10 may now be appreciated by referring specifically to FIGS. 3 and 4 of the drawings. When it is desired to operationally position a drain cover, the bolt 44 is screwed only a minimal amount into the plug 40 so that said plug depends substantially completely out of and beneath the lower bore section 26. The four slugs 34 are inserted into the radial slots 32 and pushed all the way in so that the angled faces 36 actually enter the bore section 26 while the distal corners 38 are withdrawn within the body wall 14 (see FIG. 3). The drain cover may now be readily inserted into the drain pipe until it is supported on the floor by the top disc 12. Screwing of the bolt now draws the plug 40 up into the body cavity 26 causing the plug to cam against the faces 36 and force the slugs 34 radially outwardly. As much pressure as is desired may be applied to achieve a secure fit by virtue of the slug points 38 bearing against the inner wall of the drain pipe. When it is desired to remove the drain cover, the described procedure is simply reversed by unscrewing the bolt 44 permitting the cover to be readily withdrawn. Obviously, the simple screwing and unscrewing of the bolt requires no special tools and may be accomplished with a screwdriver or even a coin such as a penny or dime.

It will be understood that modifications and variations may be effected without departing from the scope of the novel concepts of the present invention, but it is understood that this application is to be limited only by the scope of the appended claims.

The invention is hereby claimed as follows:

1. A drain cover of the character described comprising:

a cylindrical body adapted to be readily inserted into a drain pipe;

a top disc of larger diameter than said cylindrical body and adapted to engage the top surface of the floor surrounding a drain pipe;

draining openings formed in said disc and cylindrical body;

adjustable locking means carried by said cylindrical body;

wall means in said cylindrical body isolating said locking means from said drainage openings; and means associated with said body for selectively moving said locking means into locking engagement with a drain pipe wall, and being manually operable from above said disc when the drain cover is operationally positioned.

2. A drain cover according to claim 1 wherein said body is formed with a plurality of radial slots opening to the outer vertical wall of said body, and said locking means comprises slugs slidably positioned in said slots.

3. A drain cover according to claim 2 wherein said body is formed with a central bore communicating with said slots, and said third mentioned means is movable in said bore for forcing said slugs radially outwardly.

4. A drain cover according to claim 3 wherein said bore comprises a frusto-conical lower section opening to the bottom of the body and a round upper section opening to the top disc, and said second mentioned means comprises a complementary frusto-conical plug having a threaded central threaded hole and a cooperating threaded bolt slidably positioned in said upper bore section.

5. A drain cover according to claim 4 wherein said slugs are trapezoidal in shape having short angled ends and opposed sharp corners, said plug acting on one of said angled ends to cam the same outwardly when the bolt is screwed tight and forcing the opposed sharp corner into locking engagement with the pipe.

6. A drain cover according to claim 4 and comprising further a pair of fins on said plug and pairs of opposed vertical slots formed in said lower bore section for receiving said fins and preventing rotation of said plug.

7. A drain cover according to claim 1 in which said top disc is slightly convex in section and comprises further a plurality of elongated arcuate weep holes and a depending lip which raises said weep holes slightly above the floor to permit drainage of low lying liquids therethrough.

8. A drain cover according to claim 7 wherein said top disc and cylindrical body comprise an integrally molded plastic structure.

* * * * *